US006264319B1

(12) United States Patent
Altfather et al.

(10) Patent No.: US 6,264,319 B1
(45) Date of Patent: Jul. 24, 2001

(54) PRESSURE CHANGE ACCOMMODATING INK CONTAINER AND A LIQUID INK PRINTER HAVING SAME

(75) Inventors: Kenneth W. Altfather, Fairport; Steven J. Dietl, Ontario, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/593,528

(22) Filed: Jun. 14, 2000

(51) Int. Cl.[7] ..... B41J 2/175
(52) U.S. Cl. ..... 347/86
(58) Field of Search ..... 347/84, 85, 86, 347/87, 92

(56) References Cited

U.S. PATENT DOCUMENTS 4,849,774 7/1989 Endo et al. .
5,608,437 * 3/1997 Iwata et al. ..... 347/86
5,742,312 * 4/1998 Carlotta ..... 347/87
5,940,104 * 8/1999 Karita et al. ..... 347/87
6,123,420 * 9/2000 Higuma et al. ..... 347/86

* cited by examiner

*Primary Examiner*—Judy Nguyen
(74) *Attorney, Agent, or Firm*—Tallom I. Nguti

(57) ABSTRACT

A pressure change accommodating liquid ink container is provided for installing onto the printhead of a liquid ink recording apparatus for supplying liquid ink to the printhead. The pressure change accommodating liquid ink container includes external walls, including a front wall and a top wall, defining a holding chamber for containing liquid ink; a pressure release hole formed through the top wall into the holding chamber; and a pressure compensator device mounted to the top wall over the pressure release hole and including an auxiliary chamber for accommodating a change in an internal pressure of the holding chamber when filled with liquid ink.

11 Claims, 2 Drawing Sheets

PRESSURE CHANGE ACCOMMODATING INK CONTAINER AND A LIQUID INK PRINTER HAVING SAME

BACKGROUND

This invention relates to liquid ink printers, and more particularly to a pressure change accommodating ink container or tank for use in such a liquid ink printer.

Liquid ink printers such as ink jet recording apparatus of the type frequently referred to either as continuous stream or as drop-on-demand, be they piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet recording apparatus, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet recording apparatus is described in, for example, U.S. Pat. No. 4,849,774.

The ink jet printhead may be incorporated into either a carriage type recording apparatus, a partial width array type recording apparatus, or a page-width type recording apparatus. The carriage type recording apparatus typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a supported, stationary recording medium, such as paper or a transparency.

After the swath is printed, the paper is stepped a distance equal to the height of the printed swath or a portion thereof, so that the next printed swath is contiguous or overlapping therewith. This procedure is repeated until an entire page is printed. In contrast, the page width recording apparatus includes a stationary printhead having a length sufficient to print across the width or length of a supported sheet of recording medium at a time. The supported recording medium is continually moved past the page width printhead in a direction substantially normal to the printhead length and at a constant or varying speed during the printing process.

In ink-jet printing, it is also possible to create multicolor images on a print sheet. This type of printing may be used for full-color images, such as to reproduce a color photograph, or can be employed for "highlight" color, in which colored additions are made to a main portion of the image or text, which is typically black. In either case, the most common technique for color ink jet printing has been to sequentially image two or more colors, in separate printing steps, onto the single print sheet. This superimposition can be carried out in any number of ways. To take the example of a full-width apparatus printing black and one highlight color, an apparatus may print out the entire black portion of the desired highlight image on the sheet, and then recirculate the print sheet once again to image the highlight color portion of the image onto the same sheet from another printhead loaded with the colored ink; such a system has a serious disadvantage in the production of accurate registration of the composed images.

Alternately, two printheads may be positioned very close to each other, and render the two portions of the image onto the print sheet almost simultaneously, although two different areas of the print sheet will be printed upon by the different printheads at the same time or with a small time lag. For a full-color process image, four types of ink (yellow, magenta, cyan, and black) are emitted from four separate printheads during printing as the print sheet is moved relative to them.

Ink jet recording apparatus in which the printhead and the ink supply are combined into a single replaceable "ink jet cartridge" are well known, and so are ink jet recording apparatus in which the printhead and the ink supply usually is in the form of a replaceable ink tank. This invention relates to both types of recording apparatus. Usually, the manufacturing site for the replaceable ink cartridge or tank is located at a particular altitude over sea level having a particular typical atmospheric pressure. Each replaceable cartridge or tank is filled with sufficient ink and sealed, trapping usually some amount of air trapped within the cartridge or tank at the manufacturing site. Thereafter, the filled and sealed cartridge or tank may end up, and usually ends up, being installed and used in a recording apparatus that, for example, may be located several thousand feet above sea level greater than the manufacturing site. In such a case, some conventional installed ink tanks for example, are likely to, and have been found to be susceptible to leaking during installation.

It has been found that after filling the ink tank with liquid ink, and then sealing it, an air bubble is inevitably trapped in the liquid chamber at an initial internal pressure P1. At such time of sealing the tank, the pressure P1 is approximately equal to the external atmospheric pressure of the manufacturing site, resulting in an initial pressure differential between P1 and the atmospheric pressure. Thereafter, an expansion in the volume of the trapped air bubble can occur if its pressure P1 changes from high to low as is the case when the ink tank is sealed at a low altitude but is opened at a high altitude. In addition, temperature changes in accordance to Boyle's Law, can cause increases or decreases in the initial internal pressure P1, resulting in an actual and different internal pressure P3. Furthermore, in addition to significant changes in altitude or temperature, barometric fluctuations can increase or decrease the external atmospheric pressure, thereby resulting in an actual external pressure that is different from that of the manufacturing site. In either case, this creates an actual net pressure difference across the walls of the ink tank that is different from the initial pressure differential. This actual net pressure difference has been found to render the ink tank susceptible to leaking during installation given differences in altitude between a manufacturing site and the installation site.

SUMMARY OF THE INVENTION

In accordance with the present invention, there is provided a pressure change accommodating liquid ink container is provided for installing onto the printhead of a liquid ink recording apparatus for supplying liquid ink to the printhead. The pressure change accommodating liquid ink container includes external walls, including a front wall and a top wall, defining a holding chamber for containing liquid ink; a pressure release hole formed through the top wall into the holding chamber; and a pressure compensator device mounted to the top wall over the pressure release hole and including an auxiliary chamber for accommodating a change in an internal pressure of the holding chamber when filled with liquid ink.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
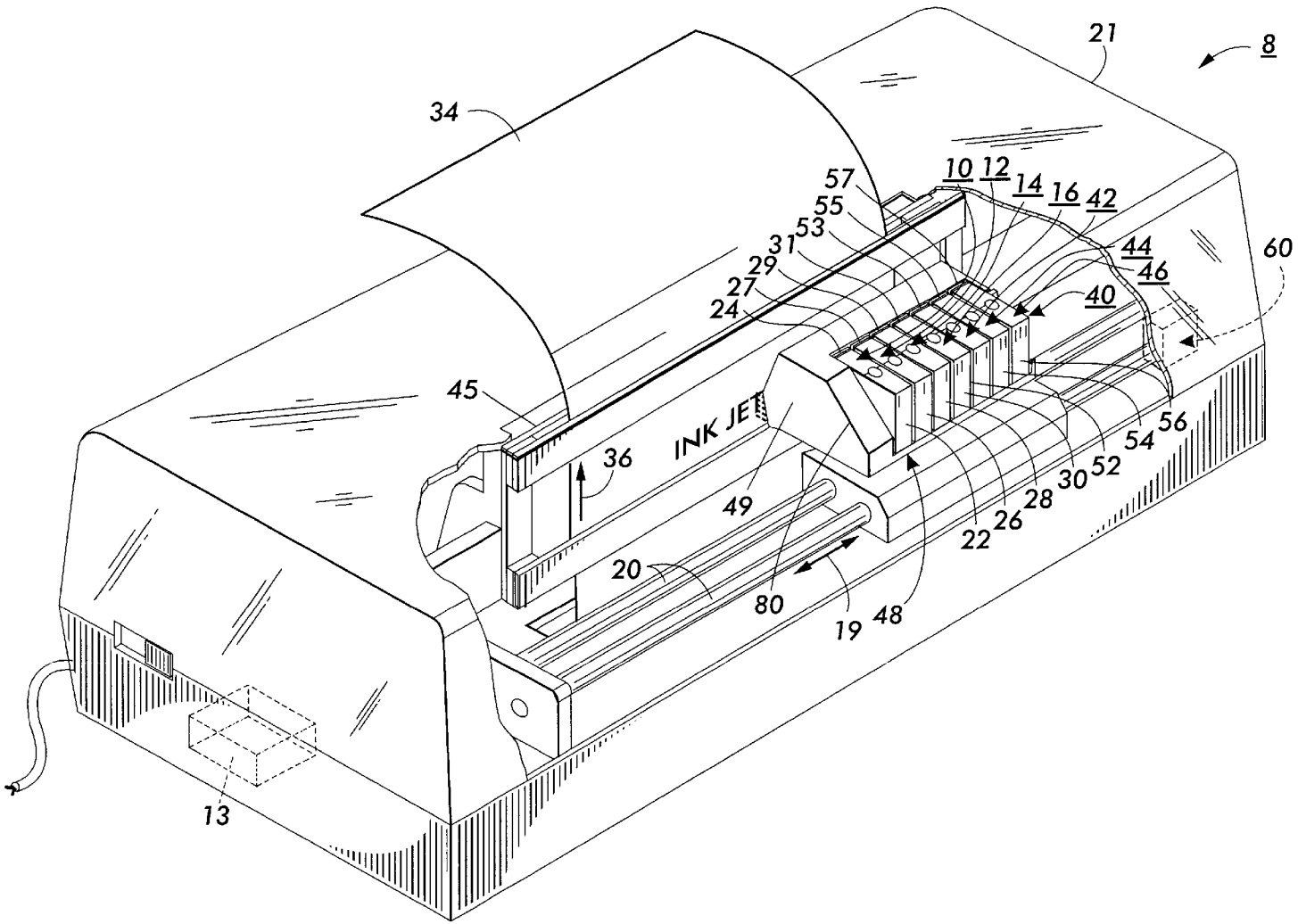
FIG. 1 illustrates a perspective view of an exemplary liquid ink recording apparatus which incorporates the pressure change accommodating ink container of the present invention.

Referring now to FIG. 1, an exemplary liquid ink recording apparatus is illustrated as 8. Although recording apparatus 8 is illustrated as a multicolor liquid ink jet recording apparatus, it is recognized that the present invention can be practiced in other types of liquid ink recording apparatus including monochrome recording apparatus, as well as in similar machines using a replaceable cartridge containing an expandable bubble of a gas such as air. Recording apparatus 8 as illustrated comprises a printhead cartridge assembly 40 that includes a plurality of ink jet printhead cartridges 10, 12, 14, 16 42, 44, and 46. The printhead cartridge assembly 40 is mounted on a carriage 18 supported by carriage rails 20. The carriage rails are supported by a frame 21 of the ink jet recording apparatus 8.

Importantly in accordance with the present invention, each printhead cartridge includes the pressure change accommodating ink container or tank 22, 26, 28, 30, 52, 54, and 56 of the present invention (to be described in detail below). Each pressure change accommodating ink container or tank 22, 26, 28, 30, 52, 54, and 56, is removably mounted to the cartridge, and contains ink for supply to an associated thermal ink jet printhead 24, 27, 29, 31, 53, 55, 57. As is well known, each such printhead selectively expels droplets of ink under control of electrical signals received from a controller (not shown) of the recording apparatus 8 through an electrical cable (not shown).

For example, the printhead cartridge 10 includes an ink container or tank 22, and a printhead 24; and the cartridge 12 includes an ink container or tank 26, and an associated printhead 27. The same is true of the rest of the printhead cartridges as shown. Each ink container or tank contains a different color ink which is fluidly connected to its associated printhead by a manifold (not shown). Each printhead comprises a plurality of ink channels which carry ink from the associated container to respective ink ejecting orifices or nozzles, as is well known.

During printing, the carriage 18 reciprocates back and forth along the carriage rails 20 in the direction of the arrow 19, so that the entire width traversed constitutes a scanning path. The actual printing zone is contained within the scanning path. As the printhead cartridge assembly 40 reciprocates back and forth along a print path and past a recording medium 34, such as a sheet of paper or a transparency, droplets of ink are expelled from selected ones of the nozzles of appropriate printhead cartridges (depending on the color ink being printed) towards the sheet of paper. Typically, during each pass of the carriage 18 the recording medium 34 is held stationary. At the end of each pass, the recording medium 34 is stepped in the direction of the arrow 36. For a more detailed explanation of the operation of recording apparatus 8, reference is hereby made to U.S. Pat. Nos. 4,571,599, 4,833,491, and U.S. Pat. No. Reissue 32,572, which are incorporated herein by reference. When idle or not printing, the entire printhead cartridge assembly is moved away from the printing zone, and preferably to a maintenance station (not shown) but would be to the far right (FIG. 1) of the printing zone.

To recap FIG. 1, the multi-color liquid ink recording apparatus 8 is suitable for printing quality multi-color ink images on the sheet or recording medium 34. As shown, the liquid ink recording apparatus 8 includes the frame 21, a printhead cartridge assembly 40 including a plurality of printhead cartridges as shown, and recording media support 45 for supporting and feeding a recording media such as a sheet 34. In accordance with the present invention, each printhead cartridge includes a replaceable pressure change accommodating ink container or tank 22, 26, 28, 30, 52, 54, 56 that supplies ink to the associated printhead.

As pointed out above, usually, the manufacturing site for the replaceable ink container or tank 22, 26, 28, 30, 52, 54, 56 is located at a particular altitude over sea level having a particular typical atmospheric pressure. Each replaceable container or tank is filled with sufficient ink and sealed, trapping usually some amount of air trapped within the container or tank at the manufacturing site. Thereafter, the filled and sealed container or tank may end up, and usually ends up, being installed and used in a recording apparatus that, for example, may be located several thousand feet above sea level greater than the manufacturing site. In such a case, some conventional installed ink tanks for example, are likely to, and have been found to be susceptible to leaking during installation.

It has been found that after filling the ink tank with liquid ink, and then sealing it, an air bubble is inevitably trapped in the liquid chamber at an initial internal pressure P1. At such time of sealing the tank, the pressure P1 is approximately equal to the external atmospheric pressure of the manufacturing site, resulting in an initial pressure differential between P1 and the atmospheric pressure. Thereafter, an expansion in the volume of the trapped air bubble can occur if its pressure P1 changes from high to low as is the case when the ink tank is sealed at a low altitude but is opened at a high altitude. In addition, temperature changes in accordance to Boyle's Law, can cause increases or decreases in the initial internal pressure P1, resulting in an actual and different internal pressure P3. Furthermore, in addition to significant changes in altitude or temperature, barometric fluctuations can increase or decrease the external atmospheric pressure, thereby resulting in an actual external pressure that is different from that of the manufacturing site. In either case, this creates an actual net pressure difference across the walls of the ink tank that is different from the initial pressure differential. This actual net pressure difference has been found to render the ink tank susceptible to leaking during installation given differences in altitude between a manufacturing site and the installation site.

For example, an ink tank manufacturing site in the state of New York will have an altitude that is approximately 800 ft. with a normal barometric pressure of 14.28 PSI. On the other hand, the installation and use site for such tanks may be in Denver, Colo. where the altitude is at 5,000 ft. with a normal barometric pressure of 10.92 PSI. In such a case, when the tank is opened for installation at arrival in Denver, a pressure difference of 3.36 PSI will exist, and instantaneously, at the moment of opening the tank, is likely to force ink out of the previously sealed (but now opened) discharge port or vent of the tank, thereby creating a leak.

Figure 2:
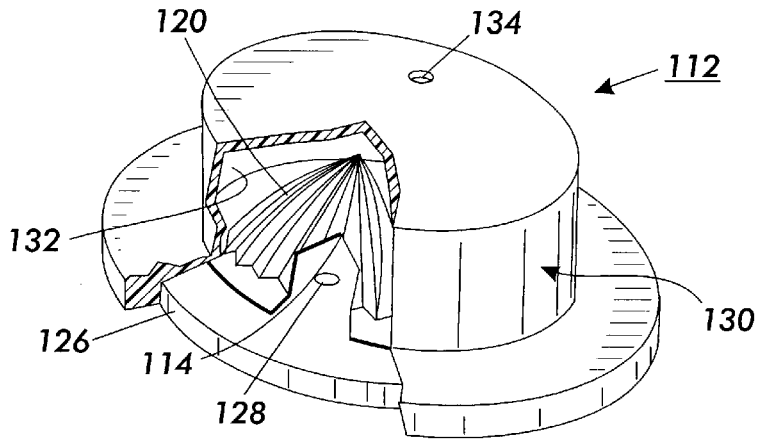
FIG. 2 is a vertical section of the pressure change accommodating ink container of the present invention.
Figure 3:
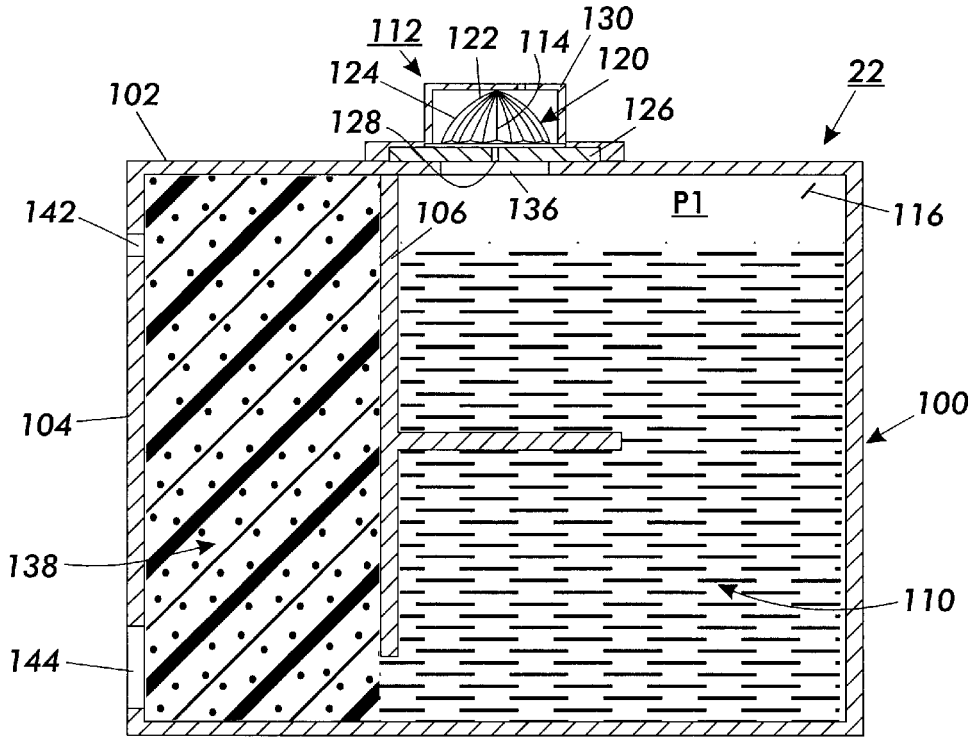
FIG. 3 is a perspective cut away view of the pressure compensator device of the pressure change accommodating ink container of the present invention.

Referring now to FIGS. 2–3, there is provided in accordance with the present invention, details of the pressure change accommodating ink container or tank 22, 26, 28, 30, 52, 54, 56, for example, that is not susceptible to leaking during installation, even if the altitude of the installation site is several thousand feet higher than the manufacturing site. The pressure change accommodating ink container or tank 22, 26, 28, 30, 52, 54, 56, is identical one to another but a numbered differently because they may each contain a different color ink. Therefore, description of the pressure change accommodating ink container or tank 22 of FIG. 3 will suffice as a description of the rest of them.

Thus the pressure change accommodating ink container or tank 22 as shown comprises walls 100 defining a holding chamber 110 for containing liquid ink, and an air bubble therein having an internal pressure P1. When containing a level of liquid ink, the holding chamber 110 has a top portion 116 above the level of liquid ink therein. As further shown, the pressure change accommodating ink container or tank 22 includes a pressure compensator device 112, that is in fluid communication with the holding chamber 110, as well as includes an auxiliary chamber 114, for accommodating a change in the internal pressure P1 of the holding chamber 110, when containing the level of liquid ink.

The auxiliary chamber 114 is located above the top portion 116 of the holding chamber 110, and is defined by materials including in part a gas and fluid impermeable flexible film material forming a bellows member 120 that defines a top 122 and sides 124 of the auxiliary chamber 114. The flexible film material for example is polyethylene film. The flexible film forming the bellows member 120 may be metallized to further decrease its permeability to vapors. The auxiliary chamber 114 is also defined in part by a base plate 126 that may be circular, and that is attached at its periphery to a bottom of the bellows member 120. The base plate 126 includes a fluid flow hole 128 for communicating between the auxiliary chamber 114 and the holding chamber 110.

The flexible film forming the bellows member 120 can have a low Young's modulus of resiliency of about 0.01 to 0.23 PSI (which is the Young's modulus for low density polyethylene film). The film as such is expandable and collapsible as a function of the internal pressure P1 of the holding chamber 110, or as a function of change in a pressure differential between the internal and external pressures on the walls 100 of the pressure change accommodating ink container or tank 22. As shown, a shell member 130 defines a protective chamber 132 over the bellows member 120, and includes a vent hole 134 formed through its top portion for air and pressure communication between the protective chamber 132 and an environment external to the capacitor device 112.

As shown, the pressure compensator device 112 is mounted within the top portion 116 of the holding chamber and to one of the walls, for example a top wall 102. The pressure change accommodating ink container or tank 22 as shown, includes a pressure release hole 136 formed through the one of the walls, for example the top wall 102 into the holding chamber 110, and aligned with the fluid flow hole 128 of the base plate 126. The base plate 126 is hermetically sealed to the one of the walls, for example the top wall 102, and over the pressure release hole 136.

As further shown, the pressure change accommodating ink container or tank 22 includes a front wall 140 adjoining a foam chamber 138 that is separated from the holding chamber 110 by an internal wall 106, but is in fluid communication with the holding chamber 110. The front wall has formed therethrough and at a top portion thereof, a venting aperture 142 and an ink discharge port 144 that are both sealed with a foil seal (not shown) that is to be removed just prior to installation of the container or tank 22 into the recording apparatus 8. Thus the foil seal is mounted externally over the front wall 140 for sealing the venting aperture 142 and the liquid ink discharge aperture or port 144.

The pressure compensator device 112 is thus made an integral part of the pressure change accommodating ink container or tank 22. Ordinarily, an air bubble trapped in the liquid or holding chamber 110 of the tank 22 expands and "instantaneously" moves ink from the liquid holding chamber 110 to the foam chamber 138 due to the pressure difference between the air bubble and a high altitude environment. This movement of the ink supersaturates foam in the foam chamber 138, eventually causing ink to leak when the closure or foil seal is removed for the purpose of installing the tank 22 into the recording apparatus.

The pressure compensator device 112 is attached to an ink tank 22 in a manner that allows the liquid holding chamber 110 of the tank to communicate with the space or auxiliary chamber 114 between the bellows member 120 and the base plate 126, through the fluid flow hole 128 in the base plate. One possible location for attaching the pressure compensator device 112 to the ink tank is over the fill hole of the ink tank 22, in which case the pressure release hole 136 would have been the tank fill hole at manufacturing.

In operation, if the pressure P1 inside the tank becomes positive with respect to the environment (due to temperature or altitude changes), ink and/or air will be forced into the space or auxiliary chamber 114 between the bellows member 120 and the base plate 126. The bellows member 120 is designed to expand easily, and in such a way, that the internal pressure difference is minimized.

For example, where the air bubble size is typically 0.9 ml's in volume, if the bellows is designed to accommodate expansion to 8000 ft., the bellows volume would need to be approximately 0.3 ml's. This could be achieved by a cylindrical bellows member having a 10 mm base and a 3.8 mm height.

Under this condition, the aforementioned example of a tank manufactured in New York State but used in Denver Colo., results in no leaked ink at opening, because there is no motive force. During subsequent operation of the ink tank 22, ink is withdrawn and the pressure in the liquid chamber 110 decreases. As the ink level in the holding chamber 110 falls, at some point, ink and/or air captured under the bellows member 120 is pulled back into the holding chamber 110.

The tank 22 is designed to perform with the liquid holding chamber 110 operating at a negative pressure of a few inches of water. Because the bellows member 120 is prevented from collapsing into the liquid holding chamber 110 by the presence of the base plate 126, that condition (of ink within the auxiliary chamber 114 being pulled back into chamber 110) is established within a relatively short period of operation. In fact, the initial vacuum priming operation that occurs automatically with tank installation will likely establish this condition.

As can be seen, there has been provided a pressure change accommodating liquid ink container is provided for installing onto the printhead of a liquid ink recording apparatus for supplying liquid ink to the printhead. The pressure change accommodating liquid ink container includes external walls, including a front wall and a top wall, defining a holding chamber for containing liquid ink; a pressure release hole formed through the top wall into the holding chamber; and a pressure compensator device mounted to the top wall over the pressure release hole and including an auxiliary chamber for accommodating a change in an internal pressure of the holding chamber when filled with liquid ink.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. A pressure change accommodating device for mounting to a wall of a fluid container over a pressure release aperture through the wall, the pressure change accommodating device comprising:

(a) a base plate having a first side, and a second side hermetically sealable to the wall of the fluid container, said base plate including a fluid flow aperture formed from said second side through said first side for aligning with the pressure release aperture through the wall;

(b) a fluid impermeable and flexible film material mounted to said first side of said base plate, said fluid impermeable and flexible film material forming a bellows member defining an auxiliary chamber for accommodating a pressure change in an internal pressure of fluid in the fluid container;

(c) a protective shell member mounted to said base plate over said fluid impermeable and flexible film material for defining a protective chamber over said fluid impermeable and flexible film material; and (d) a vent hole formed through said shell member for communicating between said protective chamber and an environment external to the pressure change accommodating device.

2. The pressure change accommodating device of claim 1, wherein said fluid impermeable and flexible film material comprises polyethylene film.

3. The pressure change accommodating device of claim 1, wherein said fluid impermeable and flexible film material is expandable and collapsible as a function of the pressure change in the internal pressure of the fluid container.

4. The pressure change accommodating device of claim 1, wherein said base plate is circular.

5. The pressure change accommodating device of claim 1, wherein said fluid impermeable and flexible film material forming said bellows member is metallized for further decreasing its permeability to vapors.

6. A replaceable ink cartridge tank for containing liquid ink, the replaceable ink cartridge tank comprising:

(a) external walls, including a front wall and top wall, defining a holding chamber for containing liquid ink;

(b) a pressure release aperture formed through said top wall into said holding chamber; and (c) pressure change accommodating device mounted to said top wall over said pressure release aperture, said pressure change accommodating device comprising:

(i) a base plate having a first side, and a second side hermetically sealed to said top wall, said base plate including a fluid flow aperture formed from said second side through said first side for aligning with said pressure release aperture;

(ii) a fluid impermeable and flexible film material mounted to said first side of said base plate, said fluid impermeable and flexible film material forming a bellows member defining an auxiliary chamber for accommodating a pressure change in an internal pressure of the replaceable ink cartridge tank;

(iii) a protective shell member mounted to said base plate over said fluid impermeable and flexible film material for defining a protective chamber over said fluid impermeable and flexible film material; and (iv) a vent hole formed through said shell member for communicating between said protective chamber and an environment external to said pressure change accommodating device.

7. The replaceable ink cartridge tank of claim 6, including an internal wall dividing said holding chamber into a liquid ink only portion, and a foam and liquid ink portion.

8. The replaceable ink cartridge of claim 6, wherein said pressure release aperture is formed into said liquid ink only portion within said top wall of said holding chamber.

9. The replaceable ink cartridge tank of claim 6, including a liquid ink discharge aperture formed through said front wall into said foam and liquid ink portion of said holding chamber.

10. The replaceable ink cartridge tank of claim 7, including a venting aperture formed through a top portion of said front wall into said foam and liquid ink portion of said holding chamber.

11. An ink jet printer comprising:

(a) a frame;

(b) a recording medium handling assembly mounted on said frame;

(c) a printhead for recording liquid ink images onto said recording medium handling assembly; and (d) a replaceable ink cartridge tank for containing liquid ink, the replaceable ink cartridge tank comprising:

(1) external walls, including a front wall and top wall, defining a holding chamber for containing liquid ink;

(2) a pressure release aperture formed through said top wall into said holding chamber; and (3) a pressure change accommodating device mounted to said top wall over said pressure release aperture, said pressure change accommodating device comprising:

(i) a base plate having a first side, and a second side hermetically sealed to said top wall, said base plate including a fluid flow aperture formed from said second side through said first side for aligning with said pressure release aperture;

(ii) a fluid impermeable and flexible film material mounted to said first side of said base plate, said fluid impermeable and flexible film material forming a bellows member defining an auxiliary chamber for accommodating a pressure change in an internal pressure of the replaceable ink cartridge tank;

(iii) a protective shell member mounted to said base plate over said fluid impermeable and flexible film material for defining a protective chamber over said fluid impermeable and flexible film material; and (iv) a vent hole formed through said shell member for communicating between said protective chamber and an environment external to said pressure change accommodating device.

* * * * *